US006871584B2

(12) United States Patent
Pearson

(10) Patent No.: US 6,871,584 B2
(45) Date of Patent: Mar. 29, 2005

(54) STRAPPING MACHINE WITH SELF CLEANING FEED LIMIT SWITCH COMPONENTS

(75) Inventor: Timothy B. Pearson, Antioch, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 17 days.

(21) Appl. No.: 10/446,591

(22) Filed: May 28, 2003

(65) Prior Publication Data

US 2004/0237807 A1 Dec. 2, 2004

(51) Int. Cl.[7] ..... B65B 13/02
(52) U.S. Cl. ..... 100/26; 100/29; 100/49; 100/99; 53/589
(58) Field of Search ..... 100/1, 4, 6, 8, 100/16, 20, 29, 30, 33 R, 33 PB, 34, 48, 100/49, 99, 26; 53/589, 590, 399

(56) References Cited

U.S. PATENT DOCUMENTS 5,267,508 A * 12/1993 Yoshino ..... 100/26
5,513,482 A * 5/1996 Nagashima et al. ..... 53/582
6,637,324 B2 * 10/2003 Stamps ..... 100/26

* cited by examiner

*Primary Examiner*—Allen Ostrager
*Assistant Examiner*—Jimmy Nguyen
(74) *Attorney, Agent, or Firm*—Mark W. Croll, Esq.; Donald J. Breh, Esq.; Welsh & Katz, Ltd.

(57) ABSTRACT

A self-cleaning limit switch is for use in a strapping machine of the type configured to convey strapping material around a load, receive first and second courses of the strapping material, position, tension and seal the strapping material around a load. The strapping machine includes a strapping head having internal and external limit switch channels formed therein. The limit switch includes a sliding element having internal and external sliding portions rigidly connected to one another. The internal sliding portion is positioned in the strapping head internal limit switch channel and the external portion is positioned in the strapping head external limit switch channel. The internal and external sliding portions include an inclined surface at a rearward end thereof and upstanding walls at a forward end thereof. The internal sliding portion has a lip for engaging the second course of strapping material. The external sliding portion includes a position indicating element thereon. The sliding element is movable between a strap not present position when the second course of strapping material is not present at the limit switch, and a strap present position when the second course of strapping material is present at the limit switch. Movement of the sliding portions dislodges debris that is present in the strapping head internal and external channels. A strapping machine having a strapping head with the self cleaning limit switch is also disclosed.

9 Claims, 2 Drawing Sheets

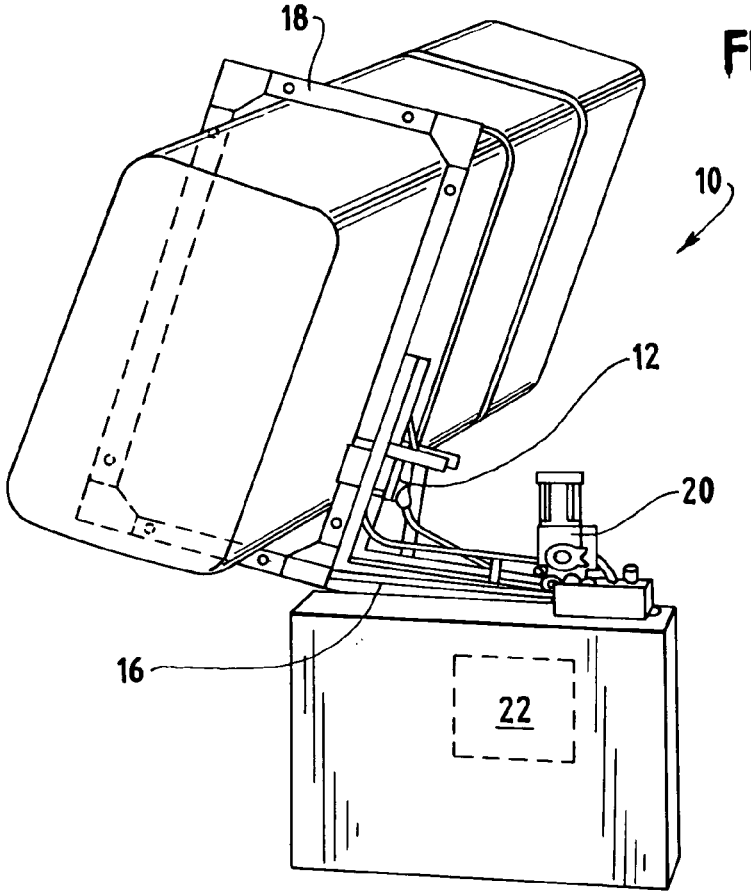
FIG. 1
FIG. 2
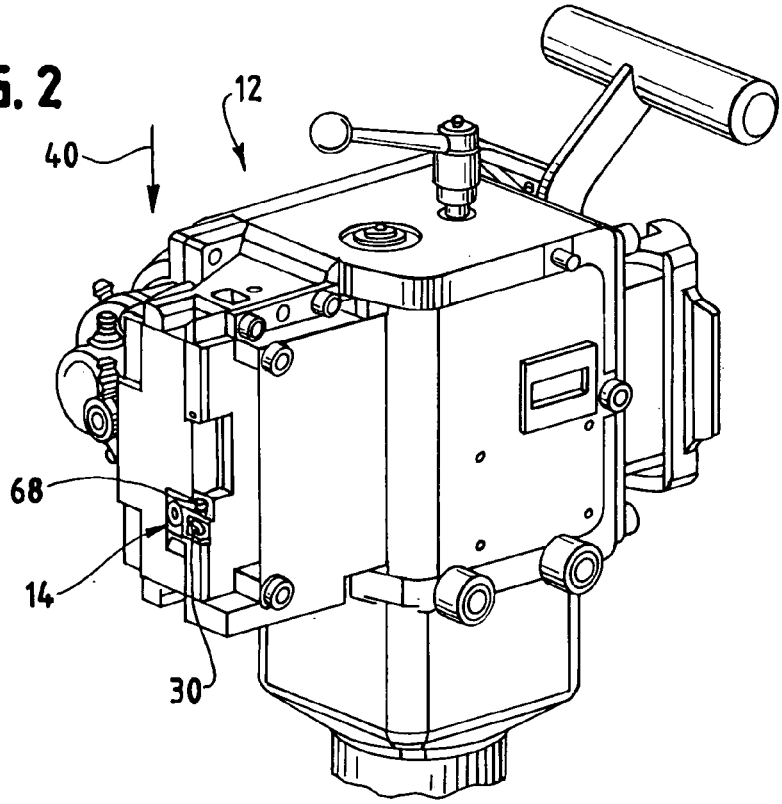

STRAPPING MACHINE WITH SELF CLEANING FEED LIMIT SWITCH COMPONENTS

BACKGROUND OF THE INVENTION

The present invention is directed to an improved feed limit switch configuration for a strapping machine. More particularly, the present invention is directed to feed limit switch configurations for a strapping machine that, by action of the switches, eliminated dust and debris from the switches.

Strapping machines are used for securing straps around loads. Known strappers include a strapping head and drive mechanism mounted within a frame. Strapping material is fed from a supply (e.g., a dispenser) into a chute that is mounted to the frame. A typical drive mechanism includes feed wheels that "push" the material through the chute via the strapping head. The leading end of the strapping material traverses the chute and re-enters the strapping head at the end of the chute.

A number of functions are carried out within the strapping head. First, the strapping material that "reenters" the chute is gripped by a gripper when the strap reaches and contacts a limit switch. With the leading end gripped, the strap is rewound and tensioned around the load. The strapping head also includes a cutter to cut the strap from the strap source or supply and a sealer to seal an overlying course of strapping material onto itself. This seal is commonly referred to as a weld and is effected by heating overlying courses of the strap by use of a vibrating element.

In order to provide a seal of the highest integrity, it is important to assure that a sufficient amount of (leading end) strap is provided onto which the trailing end strap is welded. As such, it is necessary to assure that the leading end of the strap has traveled sufficiently "far" into the strapping head. At the point at which the strap reaches its predetermined depth of travel into the head, a limit switch is contacted. Typically, such limit switches are sliding elements that generates a signal when in one sliding position, and terminates the signal when in the other of the sliding positions.

It will, however, be recognized that the environment in which strapping machines operate may be less than optimal vis-a-vis equipment operation, instrumentation, control and switching. This is due in large part to the dust and debris that is associated with the goods being strapped, as well as the strapping material itself.

Efforts have been made to prevent dust and debris from affecting the proper operation of these sliding switches. For example, seals can be positioned about the juncture of the sliding portions of the switch and the housing in which it slides. Lubricants and the like have also been used (in conjunction with seals) to prevent the introduction of contaminants. While these efforts have met with some success in limiting the ingress of contamination, they nevertheless require monitoring and maintenance to assure proper operation.

Other arrangements use compressed air to clear the spaces in and around the sliding portions of the switch to prevent the accumulation of dust and debris. Again, although these arrangements have been successful in preventing the accumulation of contaminants, these arrangements require monitoring and maintenance to assure proper operation.

Accordingly, there exists a need for a limit switch assembly that limits the introduction of contaminants to the components of strapping machine limit switches. Desirably, such a limit switch assembly prevents the accumulation of dust and debris in the pockets formed by the sliding switch components. Most desirably, such a limit switch configuration is self cleaning in that it clears dust and debris during normal switch (sliding) operation.

BRIEF SUMMARY OF THE INVENTION

A self-cleaning limit switch is configured for use in a strapping head of a strapping machine of the type that includes a feed assembly and a chute. The strapping machine is configured to convey a strapping material into the strapping head, into and around the chute and to exit the chute and return to the strapping head. The strapping head is configured to receive first and second courses of strapping material, position, tension and seal the strapping material around a load.

The strapping machine includes a limit switch assembly that limits the introduction of contaminants to the switch components. The switch assembly prevents the accumulation of dust and debris in the pockets formed by the sliding switch components and is self cleaning in that it clears dust and debris during normal switch operation.

A strapping head that is configured to include the self cleaning switch includes internal and external limit switch channels formed therein. The limit switch has a sliding element having internal and external sliding portions rigidly connected to one another. The internal sliding portion is positioned in the strapping head internal limit switch channel and the external portion is positioned in the strapping head external limit switch channel.

The internal and external sliding portions each include an inclined surface at a rearward end thereof and an upstanding wall surface at a forward end thereof. The internal sliding portion has a lip for engaging the second course of strapping material for actuating or moving the limit switch. The external sliding portion has a position indicating element thereon. Means for detecting the presence or absence of the position indicating element is mounted to the strapping head.

The sliding element is movable between a strap not present position when the second course of strapping material is not present at the limit switch, and a strap present position when the second course of strapping material is present at the limit switch. Contact of the second course of strapping material with the internal portion lip urges the limit switch from the strap not present position to the strap present position. Movement of the sliding element between the strap present and strap not present positions urges the sliding element inclined surfaces to dislodge debris that is present in the strapping head internal and external channels.

The internal and external sliding portions are preferably rigidly connected to one another, such as by a fastener. The external sliding portion can include a projecting finger, the presence or absence of which is detected by a proximity sensor. The sliding element is preferably biased to the strap not present position.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein:

FIG. 1 is a perspective view of an exemplary strapping machine having a strapping head with a self cleaning feed limit switch;

FIG. 2 is a perspective view of an exemplary strapping head having the self cleaning feed limit switch;

DETAILED DESCRIPTION OF THE INVENTION

Figure 3:
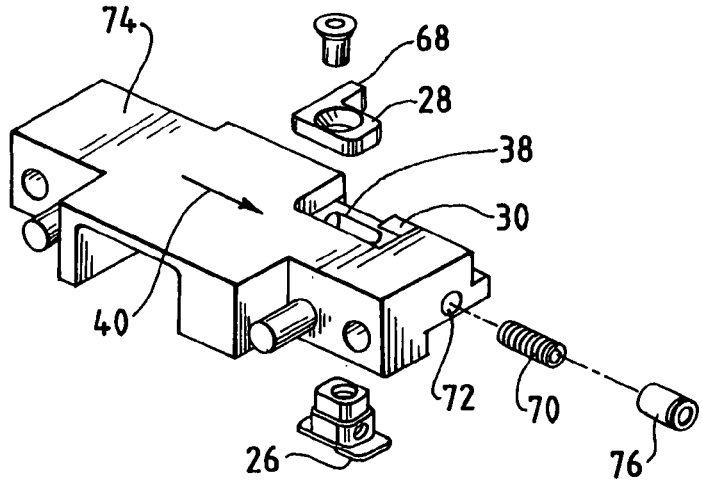
FIG. 3 is an exploded view of a portion of the strapping head anvil showing the feed limit switch components.
Figure 4:
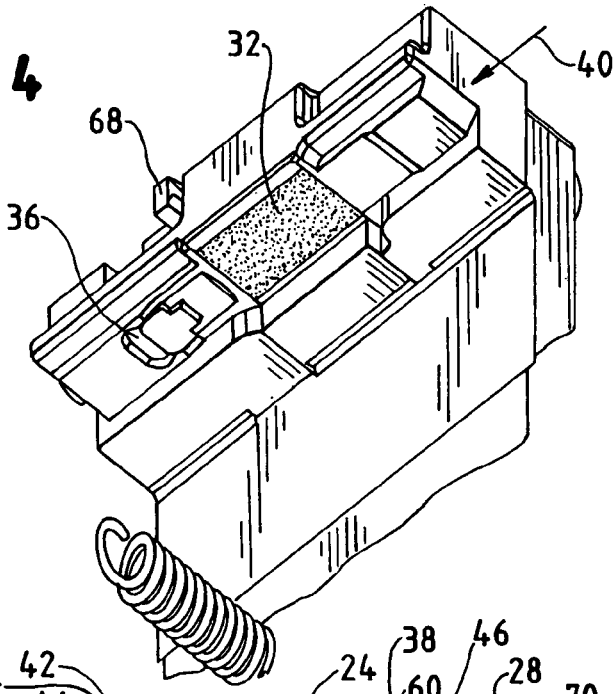
FIG. 4 is a perspective view of the underside of the anvil showing the internal sliding portion and internal channel.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular FIG. 1, there is shown a strapping machine 10 having a strapping head 12 with a self cleaning feed limit switch 14. The strapping machine 10 includes, generally, a frame 16, a strap chute 18, a feed assembly 20 and the strapping head 12. A controller 22 provides automatic operation and control of the strapper 10.

The feed limit switch 14 is used to determine when the strap material that has traversed through the chute 18 and returned to the strapping head 12 (i.e., the second course of strapping material), and is properly seated within the strapping head 12 for subsequent operations, i.e., gripping and welding or sealing.

Figure 5:
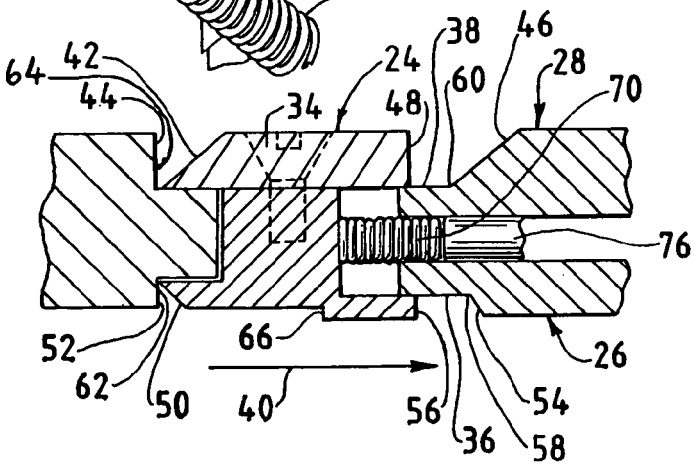
FIG. 5 is a schematic cross-sectional illustration of the self cleaning feed limit switch shown in the strap not seated condition.

The limit switch 14 is a two position switch with one or more sensors for providing indication that the strap is properly seated. The switch includes a sliding mechanical member 24 having internal and external portions 26, 28, respectively, and a proximity sensor 30 mounted adjacent the external portion 28. The internal portion 26 of the sliding member 24 is positioned adjacent a vibrating weld member 32. The internal and external sliding portions 26, 28 are mechanically connected (e.g., fastened) to one another by, for example, a threaded fastener 34 (shown in phantom in FIG. 5). In this configuration the internal and external portions 26, 28 slide as a single element 24.

Both the internal and external elements 26, 28 are positioned within internal and external open channels, 36, 38, respectively, formed in the strapping head 12. The sliding portions 26, 28 traverse (slide) back and forth between end walls of their respective channels. In known configurations, the ends of the sliding portions and the end walls of the channels are squared; that is, the ends of the walls are perpendicular to the direction of movement of the sliding portions. It has been found that dust and debris that collects in the channels can tend to pack into the corners of the channels and against the front and rear surfaces of the slide contacts. This can interfere with the sliding movement of the sliding components and cause improper operation of the sensor.

The present arrangements prevents the accumulation of dust and debris in the corners and at the front and rear surfaces of the sliding elements. For purposes of the present description, reference will be made to forward and rearward movement, as well as forward and rearward (relative) parts and components, with forward movement referring to movement in the direction of travel of the strapping material (as indicated by the arrow at 40), and forward parts and components being those parts and components on the side in the downstream (i.e., leading side) direction of travel.

It should also be noted that the present limit switch 14 arrangement is biased, with the slide 24 being biased in the rearward direction (opposite of 40). As will be described below, in this manner, the switch 14 is biased to indicate that the strap is not seated for sealing.

Referring first to the external components 28, a present slide 24 includes an inclined rear surface 42 that tends to push dust and debris away and, in those instances where accumulation may have already occurred, the inclined surface 42 tends to scrape or dislodge accumulated matter from the base of the slide channel 38 when the slide 24 moves in the rearward or biased direction. The rear wall 44 of the channel 38 (that wall opposite of the slide rear surface) is squared or generally transverse to the direction of slide 24 movement.

Conversely, the forward end 46 of the slide channel 38 is inclined, again, to urge or force debris out of the channel 38. The forward end 48 of the slide 24 is squared (or transverse to the direction of travel), but cooperates with the inclined channel surface 46 to move debris out of the channel 38. As can be seen from FIG. 5, the debris is forced outward, away from the switch 14 components.

Referring now to the internal components 26, the slide 24 includes an inclined rear surface 50 that again tends to push dust and debris away and can scrape or dislodge accumulated matter from the base of the slide channel 36 when the slide 24 moves in the rearward or biased direction. The rear wall 52 of the channel 36 (that wall opposite of the slide rear surface) is squared or generally transverse to the direction of slide movement.

Similar to the external 28 configuration, the forward end 54 of the internal slide channel 36 is inclined, again, to urge or force debris out of the channel 36. The forward end 56 of the slide 24 is squared (or transverse to the direction of travel), but cooperates with the inclined channel surface 54 to move debris out of the channel 36.

It will be appreciated that the combination and cooperation of upstanding and inclined surfaces in the internal 26 and external 28 components, with the slide 24 moving in the forward 40 or rearward direction, facilitates maintaining the internal and external channels 36, 38 clean.

That is, when moving in the forward direction 40, the combination of internal (26) inclined surface 54 and upstanding surface 56 help to maintain the channel 36 area indicate at 58 clean, and the combination of external (28) inclined surface 46 and upstanding surface 48 help to maintain the channel 38 area indicated at 60 clean. Likewise, when moving in the rearward direction (opposite of 40), the combination of internal (26) inclined surface 50 and upstanding surface 52 help to maintain the channel 36 area indicated at 62 clean, and the combination of external (28) inclined surface 42 and upstanding surface 44 help to maintain the channel 38 area indicated at 64 clean.

The internal portion 26 of the slide 24 includes a lip 66 that cooperates with the second course of strap as it moves into the strapping head 12. The strap, when properly seated, contacts the lip 66 and urges the slide 24 forward so that the sensor 30 changes state, indicating the presence of strap within the sealing head 12 (by movement of the slide 24 component). This provides a signal to the strapper motor (typically through a programmable logic controller or other control means) to isolate the power feed to the motor to stop feeding strap into the machine 10.

It will be appreciated from a study of the figures and the above-description, that the present self-cleaning limit switch assembly 14 reduces or eliminates the introduction of contaminants to the components around the limit switch 14, and prevents the accumulation of dust and debris in the pockets 58, 60, 62, 64 formed by the slide 24 components in their respective channels 36, 38 or tracks. This is due, in part, to the ability to move the proximity switch/sensor 30 away from the strap contacting components (e.g. the internal sliding portion 26), while at the same time, locating the switch/sensor 30 reasonably near the external switch portion 28. To this end, a position indicating element, specifically a projecting finger 68 extends from the external sliding portion 28 for cooperating with the proximity sensor 30. In addition, the present limit switch 14 configuration maintains the regions around the slide components 24 clean by virtue of strapper operation, e.g., during normal switch (sliding) operation, without complex compressed air systems or sealed and/or lubricated assemblies.

As set forth above, the switch 14 is biased to the strap not seated position. A present switch 14 is biased by a spring 70 that is positioned in an opening 72 in the strapping head 12 (at the anvil 74) that is retained in the opening by, for example, threaded plug 76 or the like.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A self-cleaning limit switch for a strapping head of a strapping machine of the type having a feed assembly and a chute, the strapping machine configured to convey a strapping material into the strapping head, into and around the chute and to exit the chute and return to the strapping head, the strapping machine configured to receive first and second courses of associated strapping material, position, tension and seal the strapping material around a load, the strapping head including internal and external limit switch channels formed therein, the limit switch comprising:

a sliding element having internal and external sliding positions rigidly connected to one another, the internal sliding portion positioned in the strapping head internal limit switch channel and the external sliding portion positioned in the strapping head external limit switch channel, each of the internal and external sliding portions including an inclined surface at a rearward end thereof, each of the internal and external sliding portions including an upstanding wall surface at a forward end thereof, the internal sliding portion having a lip thereon for engaging the second course of strapping material, the external sliding portion having a position indicating element thereon; and means for detecting the presence or absence of the position indicating element, wherein the sliding element is movable between a strap not present position when the second course of strapping material is not present at the limit switch, and a strap present position when the second course of strapping material is present at the limit switch, the second course of strapping material contacting the internal portion lip of the sliding element to urge the limit switch from the strap not present position to the strap present position, and wherein movement of the sliding element between the strap present and strap not present positions urges the sliding element inclined surfaces to dislodge debris that is present in the strapping head internal and external channels.

2. The self-cleaning limit switch in accordance with claim 1 wherein the internal and external sliding portions are connected to one another by a fastener.

3. The self-cleaning limit switch in accordance with claim 1 wherein the position indicating element is a projecting finger and wherein the means for detecting the presence or absence of the position indicating element is a proximity sensor configured to detect the present or absence of the projecting finger.

4. The self-cleaning limit switch in accordance with claim 1 including a biasing element for biasing the sliding element to the strap not present position.

5. A strapping machine for positioning a strapping material around an associated load, tensioning and sealing the strapping material to itself around the load, comprising:

a frame;

a chute defining a strap path, the chute being mounted to the frame;

a strapping head mounted to the frame and configured for receipt at the chute, the strapping head configured to receive first and second courses of associated strapping material, position, tension and seal the strapping material around a load, the strapping head including internal and external limit switch channels formed therein, the strapping head including a self-cleaning limit switch mounted thereto having a sliding element having internal and external sliding positions rigidly connected to one another, the internal sliding portion positioned in the strapping head internal limit switch channel and the external sliding portion positioned in the strapping head external limit switch channel, each of the interal and external sliding portions including an upstanding wall surface at a forward end thereof, the internal sliding portion having a lip thereon for engaging the second course of strapping material, the external sliding portion having a position indicating element thereon and means for detecting the presence or absence of the position indicating element, wherein the sliding element is movable between a strap not present position when the second course of strapping material is not present at the limit switch, and a strap present position when the second course of strapping material is present at the limit switch, the second course of strapping material contacting the internal portion lip of the sliding element to urge the limit switch from the strap not present position to the strap present position, and wherein movement of the sliding element between the strap present and strap not present positions urges the sliding element inclined surfaces to dislodge debris that is present in the strapping head internal and external channels.

6. The strapping machine in accordance with claim 5 wherein the internal and external sliding portions are connected to one another by a fastener.

7. The strapping machine in accordance with claim 5 wherein the position indicating element is a projecting finger and wherein the means for detecting the presence or absence of the position indicating element is a proximity sensor configured to detect the presence of the projecting finger.

8. The strapping machine in accordance with claim 5 including a biasing element for biasing the sliding element to the strap not present position.

9. The strapping machine in accordance with claim 5 wherein the internal and external sliding portions include an inclined surface at a rearward end thereof.

* * * * *